US006226897B1

(12) United States Patent
Sand

(10) Patent No.: US 6,226,897 B1
(45) Date of Patent: May 8, 2001

(54) SPORTS SHOE INTERFACE

(75) Inventor: Jeff W. Sand, San Francisco, CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 09/323,978

(22) Filed: Jun. 2, 1999

(51) Int. Cl.[7] ..... A43B 5/00
(52) U.S. Cl. ..... 36/117.1; 36/117.3; 36/107
(58) Field of Search ..... 36/117.3, 117.1, 36/115, 107, 108, 31, 73, 75 R, 117.2, 131

(56) References Cited

U.S. PATENT DOCUMENTS

| | | | | |
|---|---|---|---|---|
| 3,248,810 | * | 5/1966 | Baudou | 36/107 |
| 3,952,429 | | 4/1976 | Thomas | 36/31 |
| 4,125,274 | * | 11/1978 | Kubelka et al. | 36/117.3 |
| 4,177,584 | * | 12/1979 | Beyl | 36/117.3 |
| 4,372,062 | | 2/1983 | Tringali | 36/120 |
| 4,410,199 | | 10/1983 | Eisenberg | 280/615 |
| 5,297,349 | * | 3/1994 | Kilgore | 36/30 R |
| 5,401,041 | | 3/1995 | Jespersen | 280/14.2 |
| 5,474,322 | * | 12/1995 | Perkins et al. | 36/117.1 |
| 5,692,321 | | 12/1997 | Holstine | 36/93 |
| 5,720,117 | | 2/1998 | Toschi | 36/76 |
| 5,784,809 | | 7/1998 | McDonald | 36/117.5 |
| 5,845,421 | | 12/1998 | Tanaka | 36/117.3 |
| 5,850,702 | | 12/1998 | Okajima | 36/31 |
| 5,918,386 | * | 7/1999 | Marmonier | 36/117.3 |
| 6,006,451 | * | 12/1999 | Morris et al. | 36/115 |
| 6,017,042 | * | 1/2000 | Paris | 36/117.1 |

* cited by examiner

*Primary Examiner*—M. D. Patterson
(74) *Attorney, Agent, or Firm*—Fish & Richardson P.C.

(57) ABSTRACT

A structural interface for a sports shoe is described. An implementation of the structural interface includes a lateral beam member and a medial beam member connected together by a bridge member. The lateral and medial beam members may each include at least one mounting location for connection means and/or attachment devices. The connection means or attachment devices mate with sports apparatus, for example, snowboard bindings or bike pedals.

13 Claims, 6 Drawing Sheets

SPORTS SHOE INTERFACE

BACKGROUND OF THE INVENTION

The invention relates generally to a sports shoe and more particularly to a sports boot having a structural interface for use with an attachment device.

Sports shoes or boots designed to connect to devices such as bicycle pedals, ski bindings or snowboard bindings typically include a rigid shank. The rigid shank lies beneath the footbed and works as a leaf spring structure and provides a foundation for mounting a pin or boss for mating with an attachment device on the pedal, or to a ski or snowboard binding. These sports are associated with impact forces that are transmitted by the shank into the entire footbed, causing discomfort. Since the shank is typically close to the foot, there is little or no room to include shock absorbing materials to cushion the blows, and even when soft materials are added in strategic locations under the foot, the presence of the rigid shank is still perceptible and still causes discomfort. Consequently, during or following athletic activity, the wearer of such sports boots may experience foot fatigue and/or pain. Footwear designed for other high impact sports such as basketball or running solve this problem by constructing the outsole from various shock absorbing materials.

The popularity of sports such as bicycling, skiing and snowboarding has been increasing each year. In addition, new high-speed chair lift technology now enables skiers and snowboarders to get in more runs down the mountain during the course of a day than was possible in the past. Thus, ski and snowboard boots must be lightweight, comfortable and durable, while still providing support for the foot and the rider with a "feel" for the ski or snowboard. Thus, there is a need for a structural support system for sports shoes that will enable a rider to comfortably participate in her sport while minimizing foot fatigue and/or foot pain due to impact forces.

SUMMARY OF THE INVENTION

A structural interface for a sports shoe includes a lateral beam member having at least one mounting location, a medial beam member having at least one mounting location and at least one bridge member. The bridge member spans the width of a footbed and connects the lateral and medial beam members together.

Implementations of the invention may include one or more of the following features. At least one connection means may be attached to at least one of the mounting locations. Additionally or alternately, at least one attachment device may be attached to at least one of the mounting locations.

In another aspect, a method for manufacturing a structural interface for a sports shoe includes constructing a lateral beam member, constructing a medial beam member and constructing at least one bridge member having first and second sides. The first side of the bridge member is connected to the lateral beam member, and the second side of the bridge member is connected to the medial beam member.

One or more of the following features may be included. The lateral beam member, the medial beam member and at least one bridge member may be molded separately. Alternately, the lateral beam member, the medial beam member and at least one bridge member may be molded together to form a unitary structural interface.

Another aspect of the invention pertains to a structural interface for a sports shoe that includes at least one lateral beam member, at least one medial beam member, and a bridge member that spans the width of a footbed. The bridge member connects the lateral and medial beam members together. Other features may include at least one connection means attached to at least one of the lateral or medial beam members. Additionally or alternately, at least one attachment device may be attached to at least one of the lateral or medial beam members.

Another aspect concerns a method for manufacturing a structural interface for a sports shoe. The method includes constructing at least one lateral beam member, constructing at least one medial beam member, and constructing a bridge member having first and second sides. The first side of the bridge member is connected to each lateral beam member, and the second side of the bridge member is connected to each medial beam member. Further features may include that the lateral beam members, the medial beam members and the bridge member are molded separately. Alternately, the lateral beam members, the medial beam members and the bridge member may be molded together to form a unitary structural interface.

In yet another aspect, a sports shoe includes an upper, a structural interface and an outsole. The structural interface includes a lateral beam member attached to a lateral portion of the upper and having at least one mounting location, a medial beam member attached to a medial portion of the upper and having at least one mounting location, and a bridge member connecting the lateral and medial beam members together. Additional features may include at least one connection means attached to at least one mounting location. In addition or alternately, at least one attachment device may be attached to at least one mounting location. Further, a midsole may be connected to the outsole and to the upper, and a cushioning material may be wrapped around at least a portion of the structural interface. In addition, a foot support padding layer may be included.

Yet another aspect concerns a method for constructing a sports shoe including a structural interface having a lateral beam member, a medial beam member and a bridge member connecting the lateral and medial beam members together. The method includes constructing an upper, connecting the lateral beam member of the structural interface to a lateral portion of the upper, connecting the medial beam member of the structural interface to a medial portion of the upper, and connecting an outsole to the upper. Additional features may include connecting at least one connection means to at least one of the medial and lateral beam members, and/or connecting at least one attachment device to at least one of the medial and lateral beam members.

Another implementation concerns a structural support system for the rider of a snowboard. The support system includes at least one snowboard boot having a structural interface. The structural interface includes at least one lateral beam member attached to a lateral portion of the upper, at least one medial beam member attached to a medial portion of the upper and a bridge member connecting the lateral and medial beam members together. The support system further includes at least one connection means attached to at least one of the lateral and medial beam members, and a snowboard binding including at least one attachment device for mating with the connection means. Alternately, such a structural support system may include at least one attachment device attached to at least one of the lateral and medial beam members, and a snowboard binding including at least one connection means for mating with the attachment device.

Advantages of the invention include that the structural interface allows for a high performance, lightweight shoe design. Lightweight cushioning materials common to footwear, such as EVA and/or polyurethane and/or other shock-absorbing materials, may be used with a thin outsole when fabricating the sports shoe. In addition, the structural interface permits the foot to be closer to the sports product, such as a snowboard, than prior art sports shoe and shank designs, which improves the rider's control. Since there is no large structural shank under foot, most perceived vibrational loads that previously went into the foot during sports activity have been eliminated. Further, the structural interface may be molded as a one piece unit, and only four sizes are required to cover an entire range of foot sizes from USA shoe sizes 3 through 14. Thus, a cost savings is realized over conventional full-size foot shanks, which must be manufactured for each shoe size. Yet further, the shape and use of a bridge member makes it easy to position the structural interface within the shoe during manufacture.

Additional advantages are realized for sports such as snowboarding, because the side beam configuration of the invention provides an improved means for transmitting control forces from the foot of the rider to the binding and thus to the snowboard. The result is improved control. The medial and lateral side member structure also provides a wider, and thus more stable, connection area for a binding in addition to a strong structural connection. Furthermore, since both horizontal and vertical forces are supported by the side beams, side-to-side foot movement or "wallowing" within the sports shoe is minimized during maneuvers. The present invention also allows for low placement of the foot in relation to the sports product, because of the thin bridge member, while still permitting the use of adequate amounts of shock absorbing outsole and innersole materials under the foot for comfort. For example, a snowboard rider can assert improved control of the snowboard when her foot is comfortable and relaxed. In addition, the absence of a thick supporting shank underfoot eliminates transmission of the cold conditions to the foot.

Other features and advantages of the invention will become apparent from the following description and from the claims.

DESCRIPTION OF THE PREFERRED EMBODIMENTS

Figure 1:
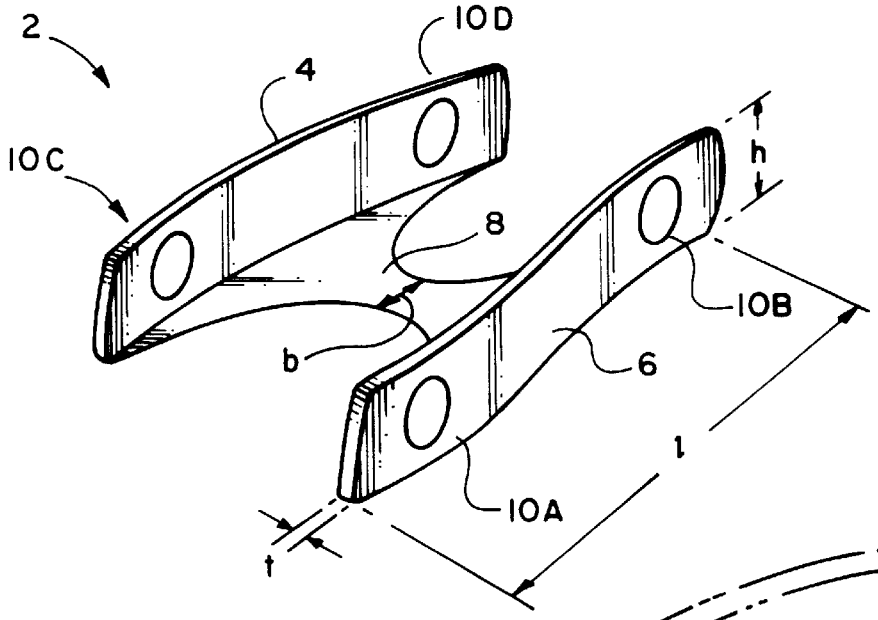
FIG. 1 illustrates a structural interface according to the invention for use in a sports shoe.

FIG. 1 illustrates an implementation of a structural interface 2 for use within a sports shoe. The structural interface includes a lateral side vertical beam 4 and a medial side vertical beam 6. The beam members 4 and 6 are shaped to conform to the outside boundaries on the medial and lateral sides of the middle portion of a footbed of a sports shoe, and are connected together by a bridge member 8 which may be a thin web. Areas 10A, 10B, 10C and 10D indicate possible mounting locations for connection means (not shown) such as a pin or boss. Such connection means are shaped to mate with an attachment device, such as a bicycle pedal attachment device or a snowboard binding. Alternately, one or both beam members 4 and 6 may include at least one attachment device, such as a block having a track, for mating with or capturing a pin or boss associated with a snowboard binding. Further, more or less mounting locations could be designated in other positions on the lateral or medial beam members.

The structural interface of FIG. 1 is typically wholly contained within a sports shoe, and thus the presence of the interface is not ordinarily apparent to a consumer. The connection means or attachment devices associated with the lateral side beam 4 and vertical side beam 6, however, usually project outwardly or horizontally from one or more of the areas 10A, 10B, 10C and 10D beyond the side wall of a vamp or midsole, and thus are noticeable by a consumer.

The structural interface 2 may be made of rubber, metal, plastic, urethane, an alloy or a composite material, or any other flexible and durable material. The structural interface may be molded as a one-piece unit, or may be manufactured in two or more separate pieces and then connected together. In addition, the side beam members 4 and 6 may be made of different materials and may differ from the material of the bridge member 8, depending on the desired bending and/or shearing characteristics and method of manufacture. Consequently, each beam member may flex and otherwise react to stress forces in a different manner.

The bridge member 8 is preferably a thin web material and is flexible so that it is substantially imperceptible to the foot. Such a bridge member readily bends or flexes so that it imparts a minimal amount of pressure on the foot during use. The bridge member connects the medial and lateral side beams for ease of manufacture, facilitates alignment of the structural interface during manufacture of a sports shoe, and does not take up much space beneath the foot. The bridge member functions as a spacer element between the side beam members, is not intended to function as a support apparatus for the foot, and is not intended to support any connection means or attachment devices.

Referring again to FIG. 1, the medial and lateral side beams 4 and 6 may have a height "h" of approximately 20 to 30 millimeters (mm), a length "l" of approximately 100 mm to 140 mm, and a thickness "t" of approximately 2.5 mm to 4.5 mm. The bridge member 8 is on the order of 1.5 mm to 2.5 mm or less in thickness, and in the illustrated embodiment is "H" shaped, having a length "b" at its midsection that is substantially less than the length "l" of a side beam member. However, it should be understood that the length, height and thickness range dimensions of the medial and lateral side beams and the bridge member disclosed above are merely exemplary and may vary, depending on the material used, the desired flexing characteristics, and the shoe size.

Figure 2:
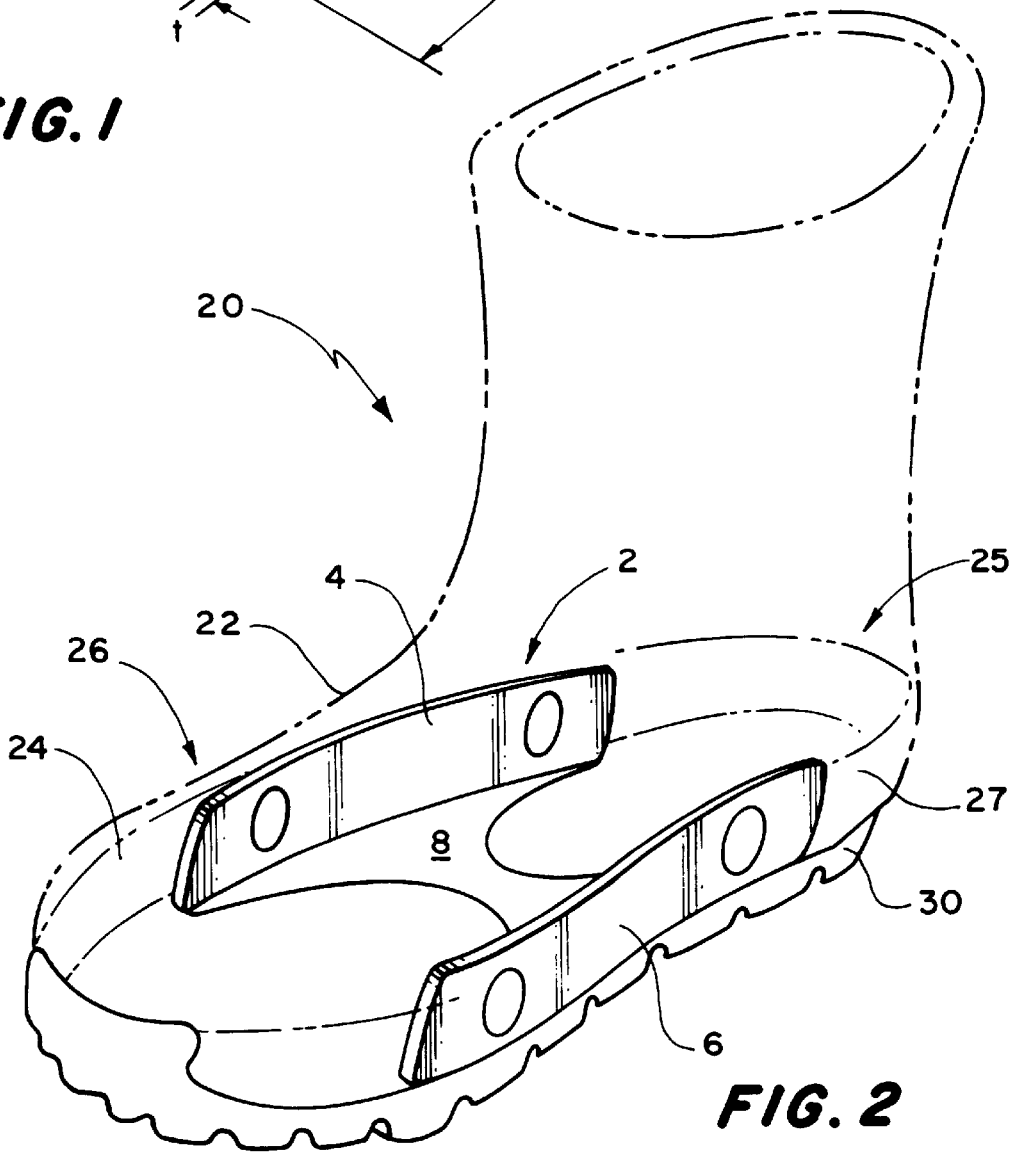
FIG. 2 is a simplified, cutaway perspective view of a sports boot including the structural interface of FIG. 1.

FIG. 2 is a simplified cutaway, perspective view of a sports boot 20 having an upper or vamp 22 shown in dotted lines, and including the structural interface 2 of FIG. 1. The sports boot includes a toe area 24, a heel area 25, a lateral side area 26 and a medial side area 27. The vamp 22 is arranged to wrap securely about a wearer's foot and ankle, and may include any of a number of known types of cinching mechanisms, such as laces (not shown), to fasten the sports boot to the foot. The vamp 22 may be constructed of a combination of durable materials or fabrics such as leather, canvas and/or waterproof materials, and portions of the upper may also be reinforced by adding layers of fabric or other materials, such as cowhide, vinyl or leather. The reinforcing layers may be used to increase wear and/or to impart either flexibility or stiffness, depending on the material used, as is known in the art. The placement of such added layers may also be dictated by fashion or style concerns. Although a sports boot upper or vamp 22 has been shown and described, any type of shoe upper can be utilized with the structural interface 2.

The vamp 22 may be attached to an outsole 30 using any number of techniques, such as by stitching or by using adhesives, and the structural interface may be integrated with or attached to the interior of the vamp 22 during construction. Alternately, the structural interface may first be aligned with and attached to the outsole or to a midsole (not shown) before the vamp is attached to the outsole. The structural interface permits construction of the shoe sole with materials and processes similar to those used in other high impact sports shoes such as basketball shoes. The side beam structure also does not appreciably add to the vertical stack height of the sports boot, thus allowing the foot to be closer to a snowboard. This is true because the bridge member 8 is thin, having a thickness on the order of 1.5 mm to 2.5 mm in most cases.

Figure 3A:
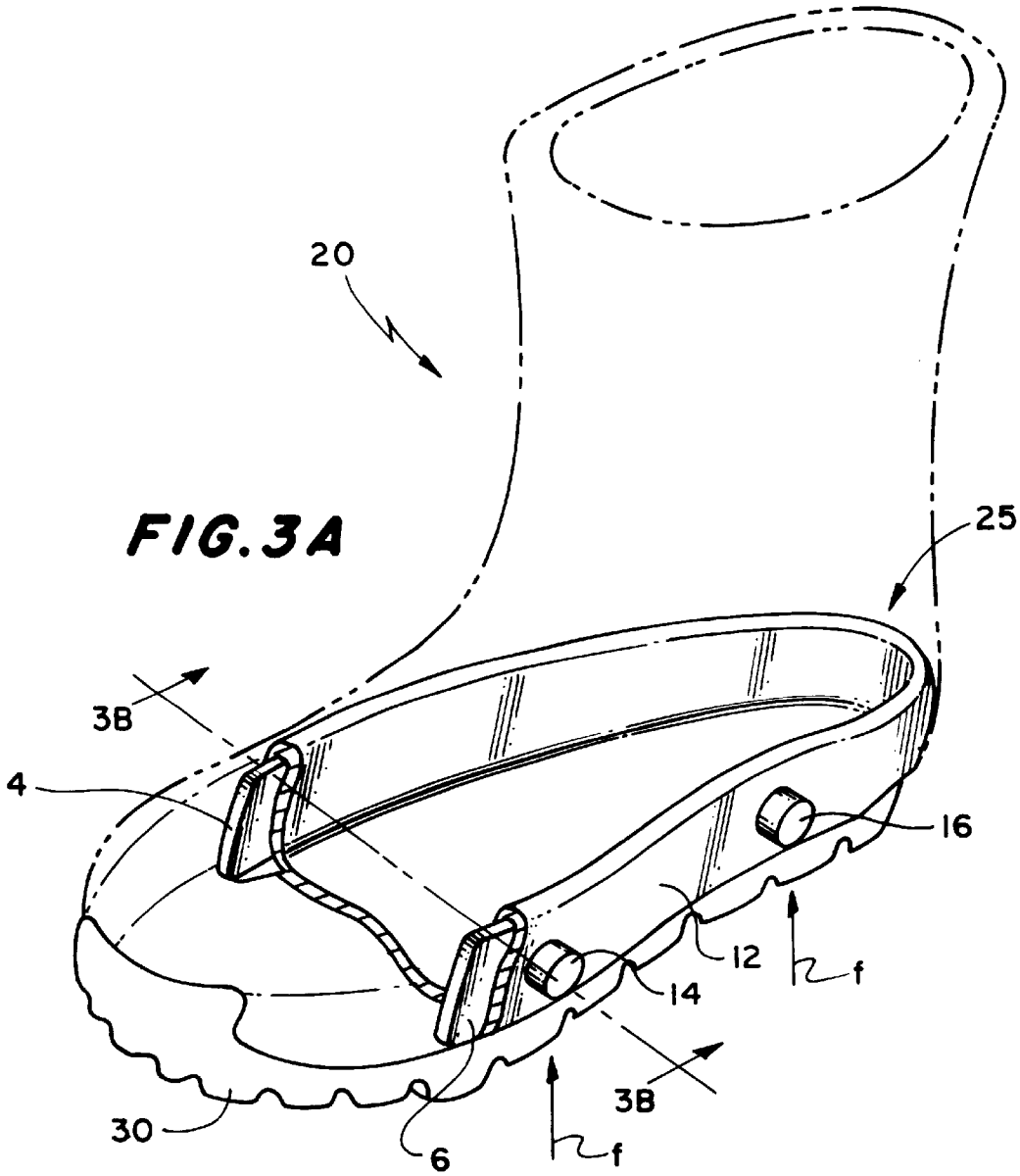
FIG. 3A is a another simplified, perspective view of the sports boot of FIG. 2.

FIG. 3A is a perspective view of the sports boot 20 of FIG. 2 including cushioning material 12 shown in cross-section wrapped about the structural interface 2, and pins 14 and 16 protruding from the medial side of the boot above the outsole 30. The pins 14 and 16 are mounted on the medial side vertical beam 6 of the structural interface at positions 10A and 10B (see FIG. 1), and the entire structural interface is encased within the cushioning material 12. One or more pins also project horizontally from the lateral side of the boot (not shown). Although the illustrated pins 14 and 16 are generally cylindrical, many other connection means of different sizes and shapes, such as substantially rectangular bosses, could be used. Furthermore, as will be described below, in addition to or instead of connection means, attachment devices may be used with the structural interface.

Figure 3B:
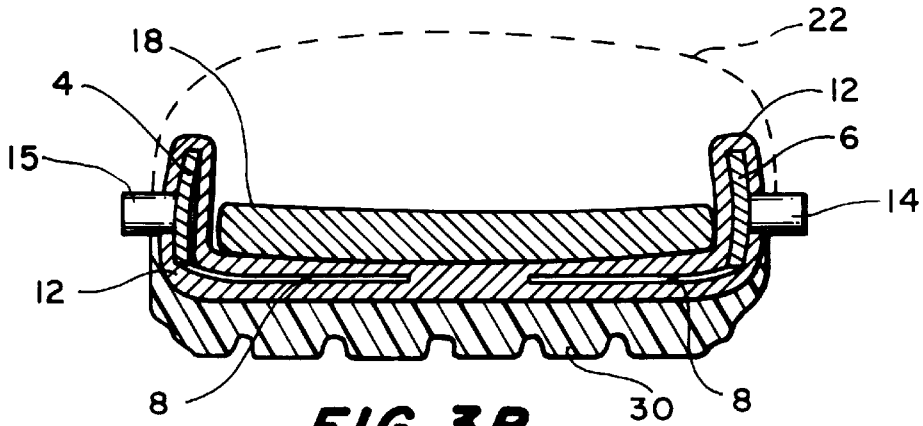
FIG. 3B is a cross-sectional front view of the sport boot of FIG. 3A taken along line 3B—3B.

FIG. 3B is a cross-sectional front view of the sport boot 20 taken along line 3B—3B of FIG. 3A. The pin 14 is connected to the medial side beam 6 and protrudes outwardly from the medial side of the vamp 22, and pin 15 is connected to the lateral side beam 4 and protrudes outwardly from the lateral side of the vamp 22. A cushioning material 12 may be wrapped about the structural interface, and this construction lies above the outsole 30. A padding material 18 may be added on top of the bridge member 8 and cushioning material 12, and may include an insole material such as terrycloth for contacting the foot. Many different construction variations could be implemented. For example, a support padding layer 18 may not be used, and/or a midsole may be included in addition to an outsole. If a midsole is used, the structural interface may be embedded therein during construction of the shoe.

Figure 4:
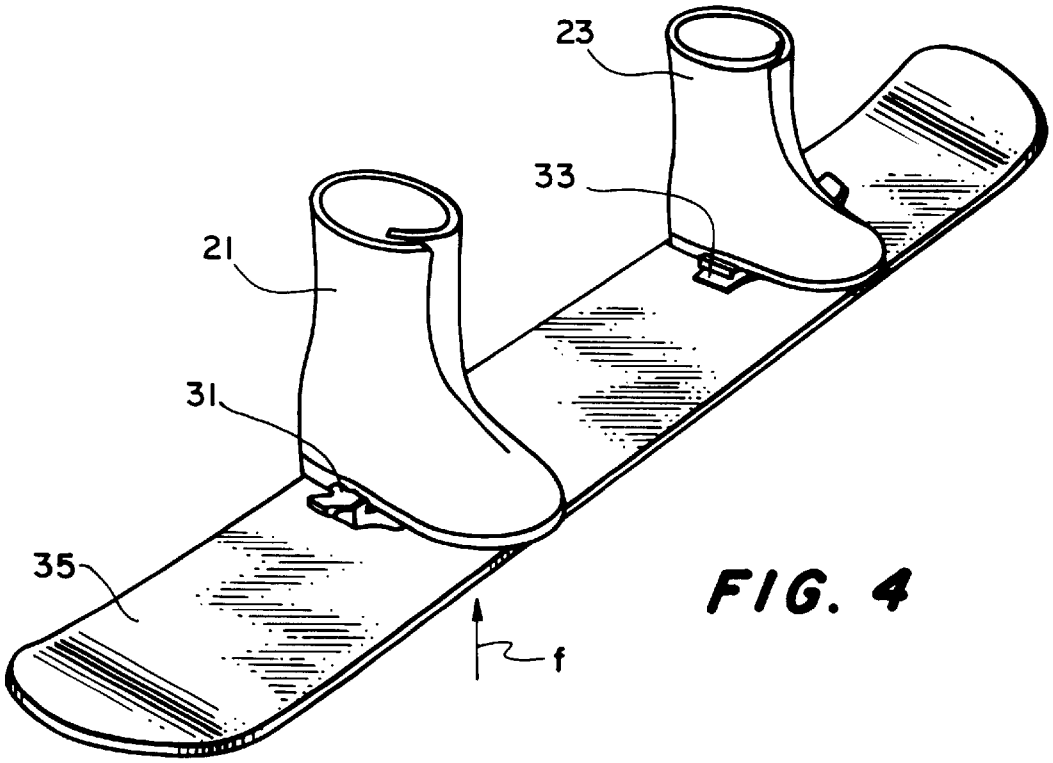
FIG. 4 illustrates two snowboard boots that include the invention connected to bindings on a snowboard.

FIG. 4 illustrates two snowboard boots 21 and 23 that each include a structural interface with connection means that align and mate with snowboard bindings 31 and 33 which are attached to a snowboard 35. The snowboard boot 21, the structural interface in the boot and the binding 31 together form a structural support system. The structural support system resists deflection, so that a snowboard rider can apply forces via the medial and lateral portions of the foot to maneuver the snowboard, which are transmitted to the snowboard via the snowboard binding and the structural interface. In addition, vertical impact forces in the direction of arrow "f" (also shown in FIG. 3) are divided into two components. The first component, the impact force from the snowboard 35, is handled by the cushioning material of the outsole, midsole and any internal padding of the sports shoe. The second component, point forces from the binding that impinge on the connection means of the structural interface, are directed by the beam members 4 and 6 (shown in FIG. 3B) into the vamp of the snowboard boot. The vertical forces from the binding impinging on the side beams effectively shear past the foot rather than impact on the bottom of the foot. Consequently, the bridge element 8 (see FIGS. 1 and 2) of the structural interface does not impart any significant amount of pressure on the bottom of the foot due to the forces from the binding. As a result, a snowboard boot including the structural interface provides a rider with improved control because impact forces are absorbed by the appropriate materials resulting in a foot that is supported in a more relaxed condition. A relaxed foot condition is important because then more energy can be expended by the rider on controlling the snowboard rather than fighting foot pain.

Figure 5D:
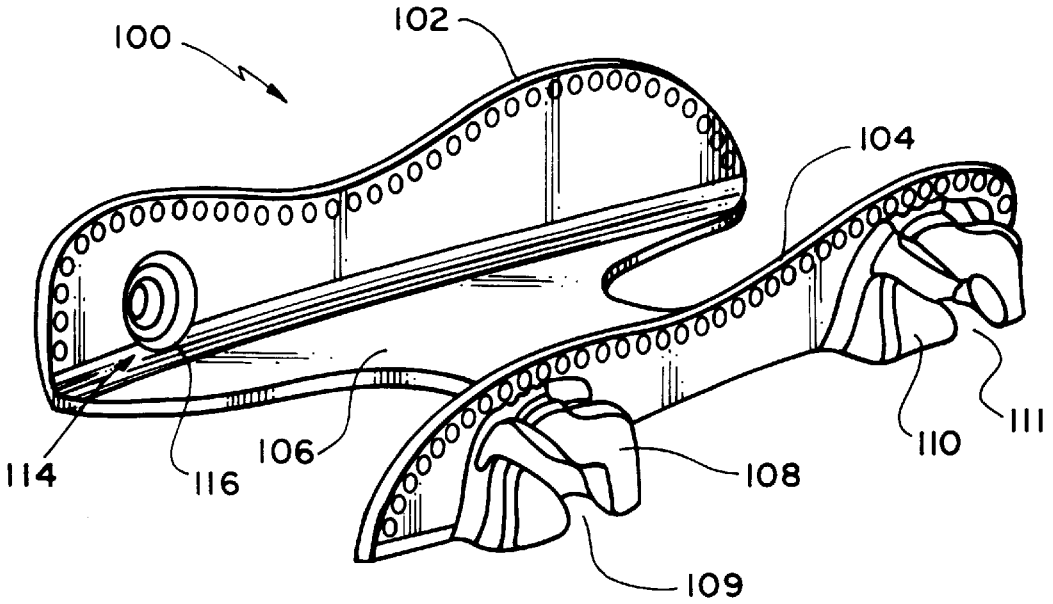
FIG. 5D is a perspective view of an alternate implementation of a structural interface according to the invention.
Figure 5A:
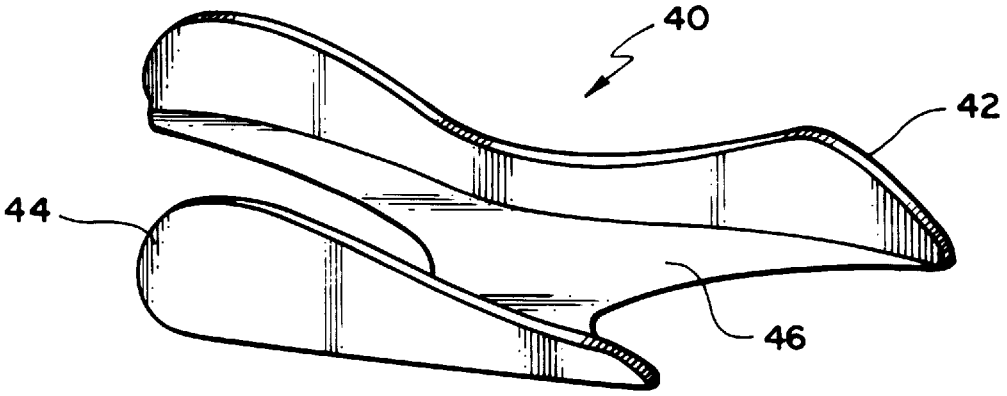
FIGS. 5A, 5B and 5C are perspective, side and top views, respectively, of another implementation of a structural interface according to the invention.
Figure 5B:
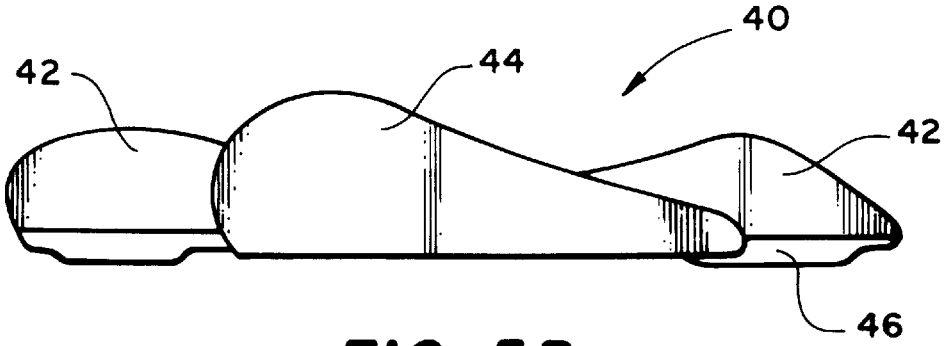
Figure 5C:
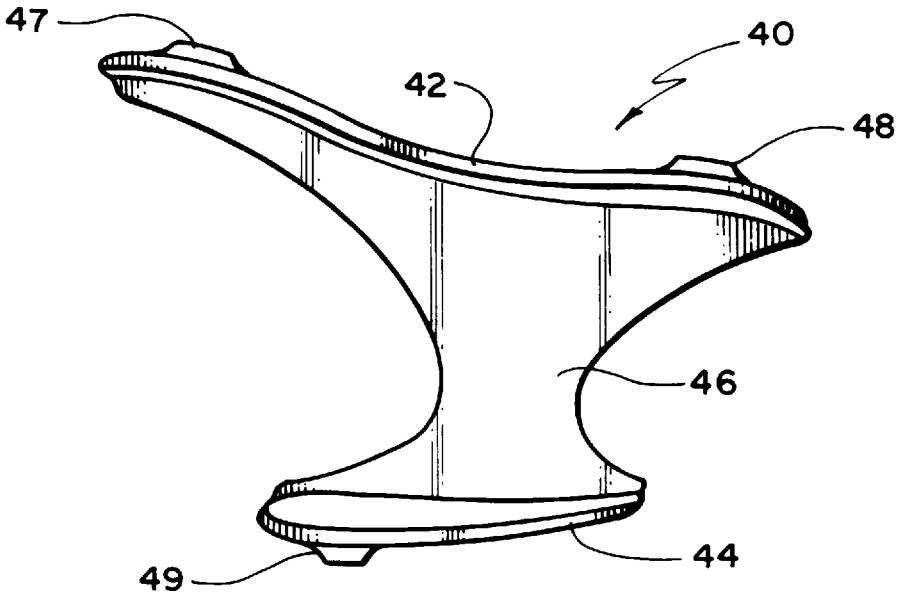

FIGS. 5A, 5B and 5C are perspective, side and top views, respectively, of another implementation of a structural interface 40. A lateral side beam 42 and medial side beam 44 are connected together by a bridge member 46. Referring to the top view of FIG. 5C, three bosses 47, 48 and 49 having a generally trapezoidal profile are shown protruding from the side beams 42 and 44. In this implementation, the lateral side beam 42 is longer than the medial side beam 44, and thus contains more potential anchor points for supporting connection means, such as the bosses 47 and 48, than the medial side beam. However, other side beam size relationships are contemplated. For example, a structural interface could be manufactured having a medial side beam that is longer than the lateral side beam and contains more connection means and/or attachment devices than the lateral side beam.

FIG. 5D is a perspective view of an alternate implementation of a structural interface 100. A lateral side beam 102 and medial side beam 104 are connected together by a bridge member 106. Two attachment devices 108 and 110 having channels or tracks 109 and 111, respectively, are attached to the medial side beam 104. Each of the tracks 109 and 111 is designed to accept a mating appendage, such as a pin or boss, that is part of, for example, a snowboard binding (not shown). An aperture 114 having a lip 116 is shown in the medial side beam 102, which can accommodate a connection means such as a boss or pin, or to which an attachment device, such as those described above, can be mounted. Thus, a structural interface may have multiple mounting areas capable of accommodating multiple types of connection means or attachment devices.

Figure 6A:
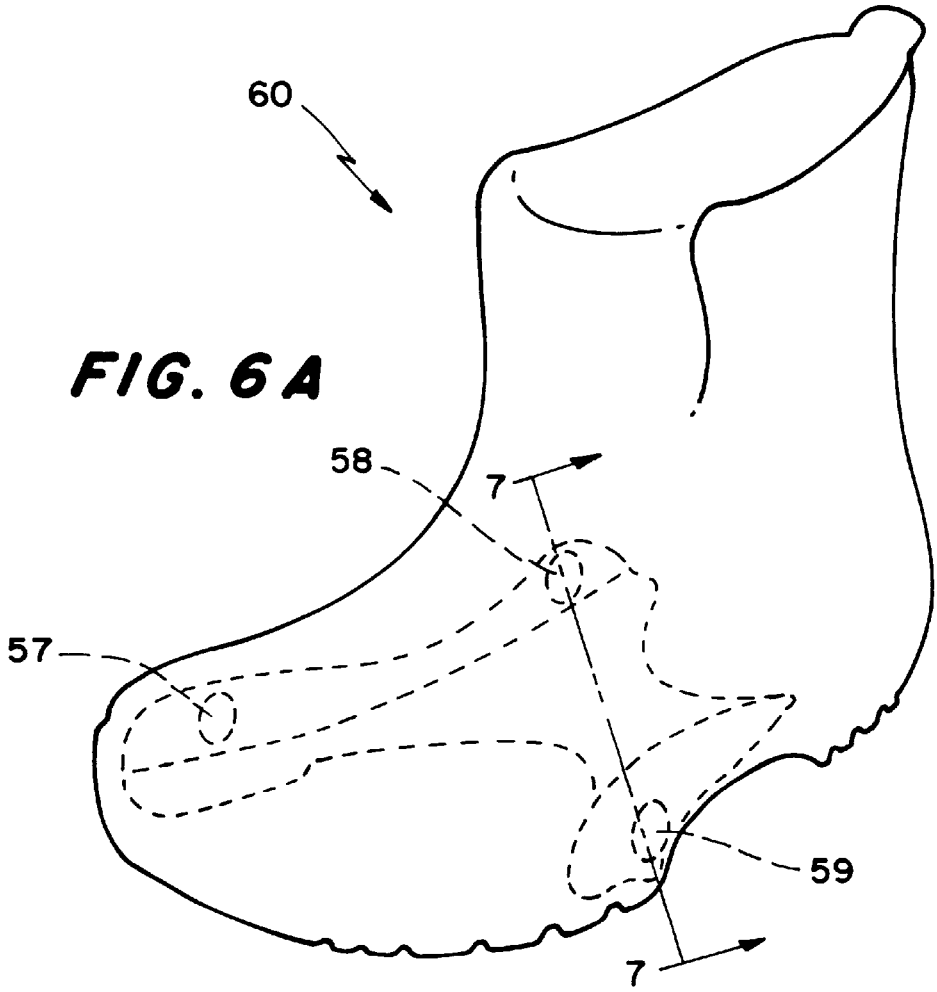
FIG. 6A is a perspective view outline of a sports boot containing a dotted line representation of another implementation of a structural interface according to the invention.
Figure 6B:
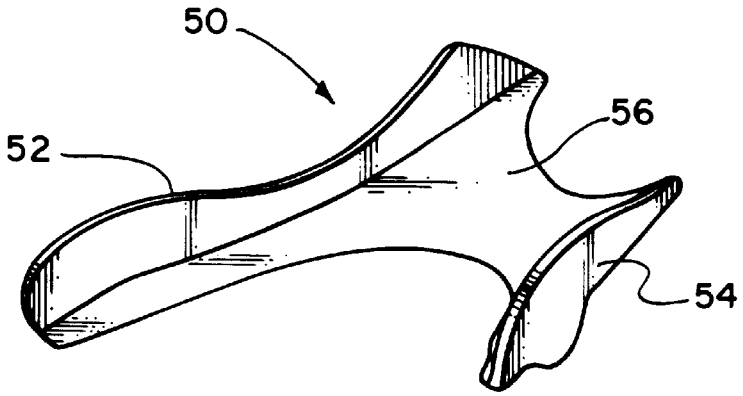
FIG. 6B illustrates the implementation of the structural interface shown in dotted line in FIG. 6A.

FIG. 6A is a perspective view outline of a sports boot 60 containing a dotted line representation of a structural interface 50 of FIG. 6B seated in position within the sports boot. The structural interface 50 of FIG. 6B is similar to the interface 40 of FIGS. 5A to 5C, but has a medial side beam 54 having a slightly different shape than the medial side beam 44. The structural interface 50 may include three mounting locations 57, 58 and 59 (see FIG. 6A) for connection means or attachment means.

Figure 7:
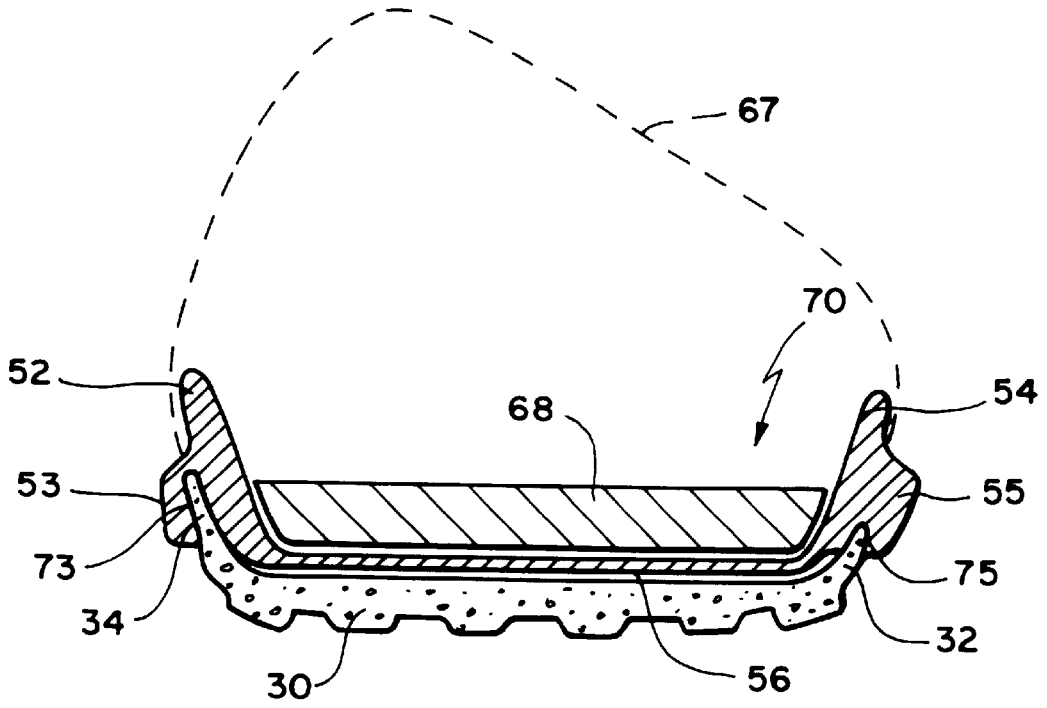
FIG. 7 is a cross-sectional depiction of the structural interface of FIG. 6B taken along dotted line 7—7 of FIG. 6A.

FIG. 7 is a cross-sectional depiction 70 of the structural interface 50 taken along dotted line 7—7 of FIG. 6A. The bridge member 56 is sandwiched between the outsole 30 and a support padding 68. The vamp 67 of sports boot 60 may be adhesively attached, stitched or otherwise connected to the lateral and medial side beams 52 and 54. Further layers, such as a midsole layer, or additional cushioning layers may be included; however, such additional layers may not be desirable. For example, in the sport of snowboarding, it is advantageous for the foot to be as close to the snowboard as possible to maximize control. Thus, in such cases, a minimum amount of padding in the footbed to provide comfort should be used.

Referring again to FIG. 7, bosses 53 and 55 have been integrally molded with the lateral and medial side beams 52 and 54 of the structural interface. In addition, the bosses 53 and 55 include notches 73 and 75 that mate with the lateral edge 32 and medial edge 34 of the outsole 30 during manufacture of the sport shoe. Although an integrally molded construction may be preferred, pins, bosses and/or other connection means or attachment devices may be separately attached after formation of the structural interface. Further, such connection means or attachment means may be removable and/or interchangeable with other types of connection means or attachment devices to allow a sports boot to mate with different types of bindings or other apparatus.

Figure 8:
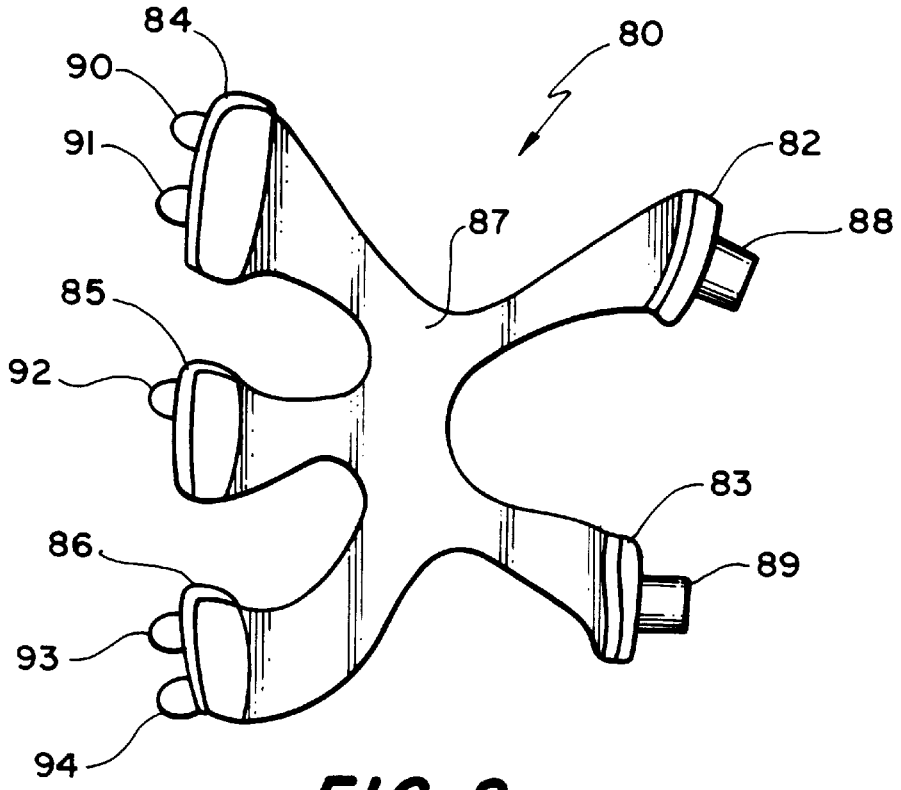
FIG. 8 is a top view of yet another implementation of a structural interface according to the invention.

FIG. 8 is a top view of another implementation of a structural interface 80. The structural interface 80 contains multiple lateral side beams 82 and 83 and multiple medial side beams 84, 85 and 86 connected together by a common thin bridge member 87. Each of the side beams 82 to 86 can provide one or more anchor points for connection means or attachment devices, and may be utilized with an outsole or midsole of a sports shoe to provide a support structure for connection to a sports apparatus. As shown, lateral side beams 82 and 83 each support one boss 88 and 89, and medial side beam member 85 supports one pin. In addition, medial side beam members 84 and 86 each support two pins 90 and 91, and 93 and 94, respectively. Thus, different combinations of connections means and/or attachment devices may be utilized. The bridge member 87 functions as a spacer to facilitate positioning of the structural interface 80 within a sports shoe or boot during manufacture as described above.

Each of the structural interface implementations described herein may be molded as a one-piece unit, including the connection means or attachment devices. One piece construction for the structural interface is cost effective because, to cover USA foot sizes 3 through 14, only four different size structural interface units, and thus only four molds, are required. Alternatively, some or all of the side beam members, bridge member, the connection means and/or attachment devices may be manufactured separately of the same or different materials, and then be connected together to satisfy performance criteria and/or interchangeability criteria.

Detailed descriptions of implementations of the invention has been disclosed, however, various modifications could be made without departing from the spirit and scope of the invention. For example, the illustrated structural interface devices generally utilize a single bridge member that is generally "X" or "H" shaped, however, bridge members having different shapes, as well as a structural interface including a plurality of bridge members of the same or different span lengths are contemplated. Furthermore, the number of pins, bosses or attachment devices connected to either of the lateral or medial beams, and their particular shapes, can vary depending on the type of mating device or binding to be used and/or the type of sports activity involved.

What is claimed is:

1. A method for manufacturing a structural interface for a sports shoe, comprising:

constructing a lateral beam member having at least one mounting location;

constructing a medial beam member having at least one mounting location;

constructing at least one flexible bridge member having first and second sides; and connecting the first side of the bridge member to the lateral beam member; and connecting the second side of the bridge member to the medial beam member.

2. The method of claim 1, wherein the lateral beam member, the medial beam member and at least one bridge member are molded separately.

3. The method of claim 1, wherein the lateral beam member, the medial beam member and at least one bridge member are molded together to form a unitary structural interface.

4. The method of claim 1 further comprising attaching at least one connection means to at least one mounting location, the connection means projecting outwardly from the upper side wall.

5. A sports shoe, comprising:

an upper having a lateral side wall and a medial side wall;

a structural interface having a lateral beam member attached to the lateral side wall and having at least one mounting location, a medial beam member attached to the medial side wall and having at least one mounting location, and a flexible bridge member connecting the lateral and medial beam members together; and an outsole connected to the upper.

6. The sports shoe of claim 5, further comprising at least one connection means attached to at least one mounting location, the connection means projecting outwardly from the side wall of the upper.

7. The sports shoe of claim 6 wherein the connection means comprises at least one of a block that includes a track, a pin, and a boss.

8. The sports shoe of claim 5, further comprising a midsole connected to the outsole and to the upper.

9. The sports shoe of claim 5, further comprising a cushioning material wrapped around at least a portion of the structural interface.

10. The sports shoe of claim 5, further comprising a foot support padding layer.

11. A method for constructing a sports shoe including a structural interface having a lateral beam member having at least one mounting location, a medial beam member having at least one mounting location and a flexible bridge member connecting the lateral and medial beam members together, comprising:

constructing an upper having a lateral side wall and a medial side wall;

connecting the lateral beam member of the structural interface to the lateral side wall of the upper;

connecting the medial beam member of the structural interface to the medial side wall of the upper; and connecting an outsole to the upper.

12. The method of claim 11, further comprising connecting at least one connection means to at least one of the medial and lateral beam members, the connection means projecting outwardly from the side wall of the upper.

13. A structural support system for the rider of a snowboard, comprising:

at least one snowboard boot including an upper having medial and lateral side walls, and including a structural interface having at least one lateral beam member attached to the lateral side wall, at least one medial beam member attached to the medial side wall and a flexible bridge member connecting the lateral and medial beam members together;

at least one connection means attached to at least one of the lateral and medial beam members and protruding from at least one side wall; and a snowboard binding including at least one attachment device for mating with the connection means.

* * * * *